United States Patent [19]

Becker

[11] 4,147,105

[45] Apr. 3, 1979

[54] PROTECTIVE DEVICE FOR A PERFECTOR PRINTING PRESS

[75] Inventor: Willi Becker, Bammental, Fed. Rep. of Germany

[73] Assignee: Heidelberger Druckmaschinen AG, Heidelberg, Fed. Rep. of Germany

[21] Appl. No.: 795,022

[22] Filed: May 9, 1977

[30] Foreign Application Priority Data

May 8, 1976 [DE] Fed. Rep. of Germany ..... 2620392

[51] Int. Cl.[2] ..... B41F 5/02

[52] U.S. Cl. ..... 101/230; 101/231

[58] Field of Search ..... 101/230, 231, 229, 183; 271/DIG. 9

[56] References Cited

U.S. PATENT DOCUMENTS

| | | | |
|---|---|---|---|
| 2,757,610 | 8/1956 | Gegenleimer et al. | 101/230 X |
| 3,654,861 | 4/1972 | Rudolph et al. | 101/183 |
| 3,742,847 | 7/1973 | Zimmermann et al. | 101/230 |
| 3,772,990 | 11/1973 | Weisgerber | 101/230 |
| 3,796,154 | 3/1974 | Weisgerber | 101/232 |
| 3,946,669 | 3/1976 | Johne et al. | 101/230 |
| 4,026,209 | 5/1977 | Hirz et al. | 101/231 |

*Primary Examiner*—Edward M. Coven

*Attorney, Agent, or Firm*—Herbert L. Lerner

[57] ABSTRACT

Device for protecting a printing machine, selectively operable in a first-form printing mode and in a perfector printing mode, against damage thereto when changing over from one to the other mode of operation thereof, the printing press having a sheet-storage cylinder and a sheet turn-over cylinder cooperating therewith, respective means on each of the cylinders for gripping a sheet being printed, means includes control cams and a gear segment turnably cooperating therewith for controlling the sheet-gripping means of the storage cylinder during change-over of the printing machine from one mode of operation to the other, and means for turning the storage cylinder per se into a respective changeover position, the device for protecting the printing machine includes means for securing the turn-over cylinder against rotation while the storage cylinder is being turned by the turning means, electromechanical means for ensuring that the control means for the gripping means of the turn-over cylinder is in the respective end position thereof, and electrical switching means cooperating with the electromechanical means for monitoring the occurrence of the turning of the gear segment and turning of the storage cylinder.

6 Claims, 9 Drawing Figures

PROTECTIVE DEVICE FOR A PERFECTOR PRINTING PRESS

The invention relates to a device for protecting a printing press or printing machine for perfector printing during change-over from first-form printing to perfector printing and vice versa, such a printing machine having a storage and turning or turn-over cylinder or drum, with means for adjusting gripper control at the turning cylinder, and with mechanical and electrical means for protecting the printing machine during the adjustment of the function or mode of operation thereof which is determined by the system.

In such machines, the sheet to be printed during the perfector printing run is transferred by a first transfer cylinder to the storage cylinder and, from the latter, is passed with the leading edge thereof by the tangent point between the storage cylinder and the succeeding turn-over cylinder. The instant the trailing edge of the sheet held by the suckers has reached the aforementioned tangential point, it is gripped by a gripper mechanism of the turn-over cylinder. Simultaneously, the leading edge of the sheet is released by the grippers of the storage cylinder, and the sheet is transferred, trailing edge leading, from the turn-over cylinder to the next impression cylinder.

With the system-determined adjustment of function or mode of operation, an adjustment of various individual functions is necessary, which demands a very heightened sense of responsibility of the machine operating personnel. If only a single important adjustment should be neglected or omitted, danger of damage to the printing machine exists, the removal of this danger requiring a great expenditure of time, the productivity of the machine being thereby considerably reduced.

In a heretofore known printing machine for perfector printing (German Published Prosecured Application DT-AS 24 19 747), during system change-over from first-form printing to perfector printing, the machine must first be brought, step-by-step, to the zero position thereof marked on the side wall. Then, by loosening a gear ring, the printing mechanism or unit forward or upstream of the turn-over device, in travel direction of the sheet, including the storage cylinder, must be separated from the printing mechanism or unit next succeeding the turn-over device. The first printing unit is then turned so far that the trailing edge of the sheets are grippable by the grippers of the turn-over cylinder. Thereafter, the gripper control at the turn-over cylinder must be changed over to perfector printing and, in a similar manner, the control cams to the grippers at the storage cylinder.

The heretofore-known change-over device makes the change-over operation simple, and avoids inaccuracies in adjustment. This does not provide assurance, however, that the operating personnel will actually perform every individual adjustment and complete it correctly.

It is accordingly an object of the invention to provide a protective device for a perfector printing press wherein each adjustment operation necessary for change-over of the operating mode of the printing press between first-form and perfector printing is protected by being dependent upon the other adjustment operations, so that the printing machine can be set in operation again only after all the adjustment operations have been correctly and fully performed.

With the foregoing and other objects in view, there is provided, in accordance with the invention, a device for protecting a printing machine, selectively operable in a first-form printing mode and in a perfector printing mode, against damage thereto when changing over from one to the other mode of operation thereof, the printing press having a sheet-storage cylinder and a sheet turn-over cylinder cooperating therewith, respective means on each of the cylinders for gripping a sheet being printed, means comprising control cams and a gear segment turnably cooperating therewith for controlling the sheet-gripping means of the storage cylinder during change-over of the printing machine from one mode of operation to the other, and means for turning the storage cylinder per se into a respective change-over position, the device for protecting the printing machine comprising means for securing the turn-over cylinder against rotation while the storage cylinder is being turned by the turning means, electromechanical means for ensuring that the control means for the gripping means of the turn-over cylinder is in the respective end position thereof, and electrical switching means cooperating with the electromechanical mean for monitoring the occurrence of the turning of the gear segment and the turning of the storage cylinder. Due to this comprehensive and interdependent protection or safeguarding of the adjustments and changes in the storage and the turn-over cylinders, assurance is provided that no adjustment operation has been omitted or incompletely executed during the system-dependent change-over of the function or mode of operation of the printing press. Damage to the machine, which might have otherwise occurred due to faulty change-over, is thereby reliably precluded.

In accordance with another feature of the invention, the printing machine has a machine frame, and a drive gear for the turn-over cylinder, the means for securing the turn-over cylinder against rotation comprising a spring-loaded locking lever tiltably mounted on the machine frame and formed with a notch therein, and a locking pin on the drive gear engageable within the notch formed on the locking lever, the means for turning the storage cylinder into a respective change-over position being effective for simultaneously engaging the locking pin in the notch.

In accordance with a further feature of the invention, the electromechanical means for ensuring that the control means for the gripping means of the turn-over cylinder is in the respective end position thereof comprises a sliding bridge mounted on the turning cylinder and having means for sliding the sliding bridge from one to another end position thereof, a socket wrench cooperating with the sliding means for sliding the bridge into a respective end position, the sliding bridge in the respective end positions thereof rendering effective the control means for the gripping means of the turn-over cylinder, an electric switch for switching off the printing machine, a spring-loaded switching linkage cooperable beyond a dead center with the electric switch, and a switch finger operatively connected to the sliding bridge and engageable with the switching linkage for actuating the electric switch. With these relatively simple means, assurance is provided that, when the printing machine is started up again, every individual adjustment operation will have been accurately performed and no disruptions or failure will occur.

In accordance with an added feature of the invention, the sliding means comprise a guide plate carried by the sliding bridge, and the socket wrench is formed with two opposed flats cooperating with the guide plate so as to be insertable and removable from the sliding means only when the sliding bridge is in one of the two end positions thereof. In this manner, incomplete adjustment of the cam rollers on the turn-over cylinder with respect to the respective cams for effecting printing on one side (first-form) and on the reverse side (perfector) is avoided.

For electrically safeguarding the adjustment of the cam rollers on the turn-over cylinder, there is provided, in accordance with an additional feature of the invention, a control segment carried by the sliding bridge, the switch finger being mounted on the control segment, a push rod connected to the switching linkage and being disposed within a range of turning of the switch finger, whereby the switch finger is turnable by the sliding of the sliding bridge so as to push the push rod and actuate the switching linkage beyond the dead center and switch off the electric switch.

In accordance with an alternate embodiment of the invention, the electric switch is disposed opposite another electric switch, both of the electric switches being on respective opposite sides of the dead center of the spring-loading switching linkage so as to be alternatingly actuatable thereby, the electric switches being electrically connected, respectively, in accordance with the respective position on the gear segment of the electrical switching means for monitoring the occurrence of the turning of the gear segment and of the storage cylinder.

Other features which are considered as characteristic for the invention are set forth in the appended claims.

Although the invention is illustrated and described herein as embodied in a protective device for a perfector printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advatages thereof will be best understood from the following description of specific embodiments when read in connection with the accompanying drawings, in which.

Figure 1:
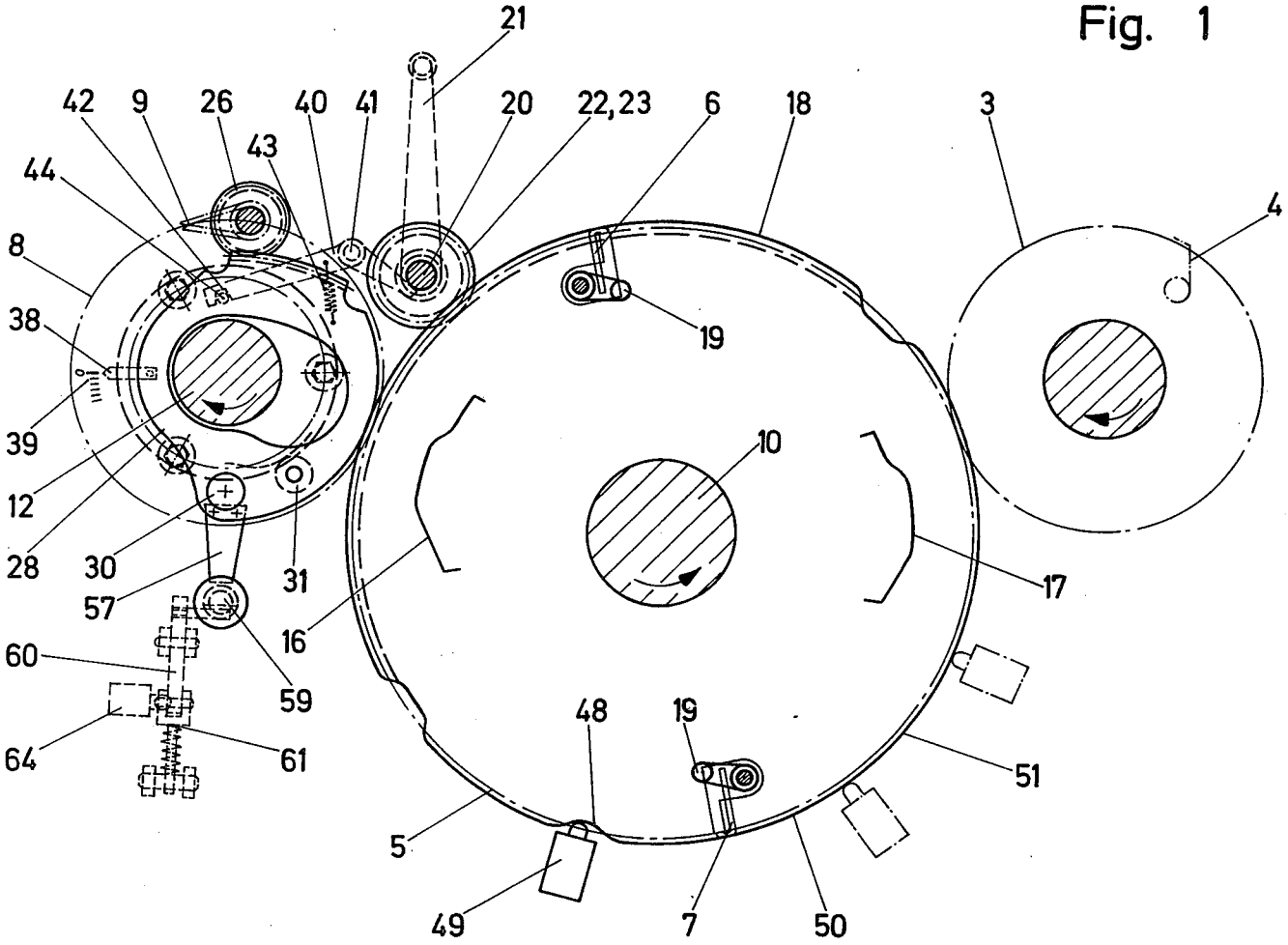
FIG. 1 is a diagrammatic side elevational view of the transfer cylinder, the storage cylinder and the turning cylinder with protective or safety devices according to the invention.
Figure 2:
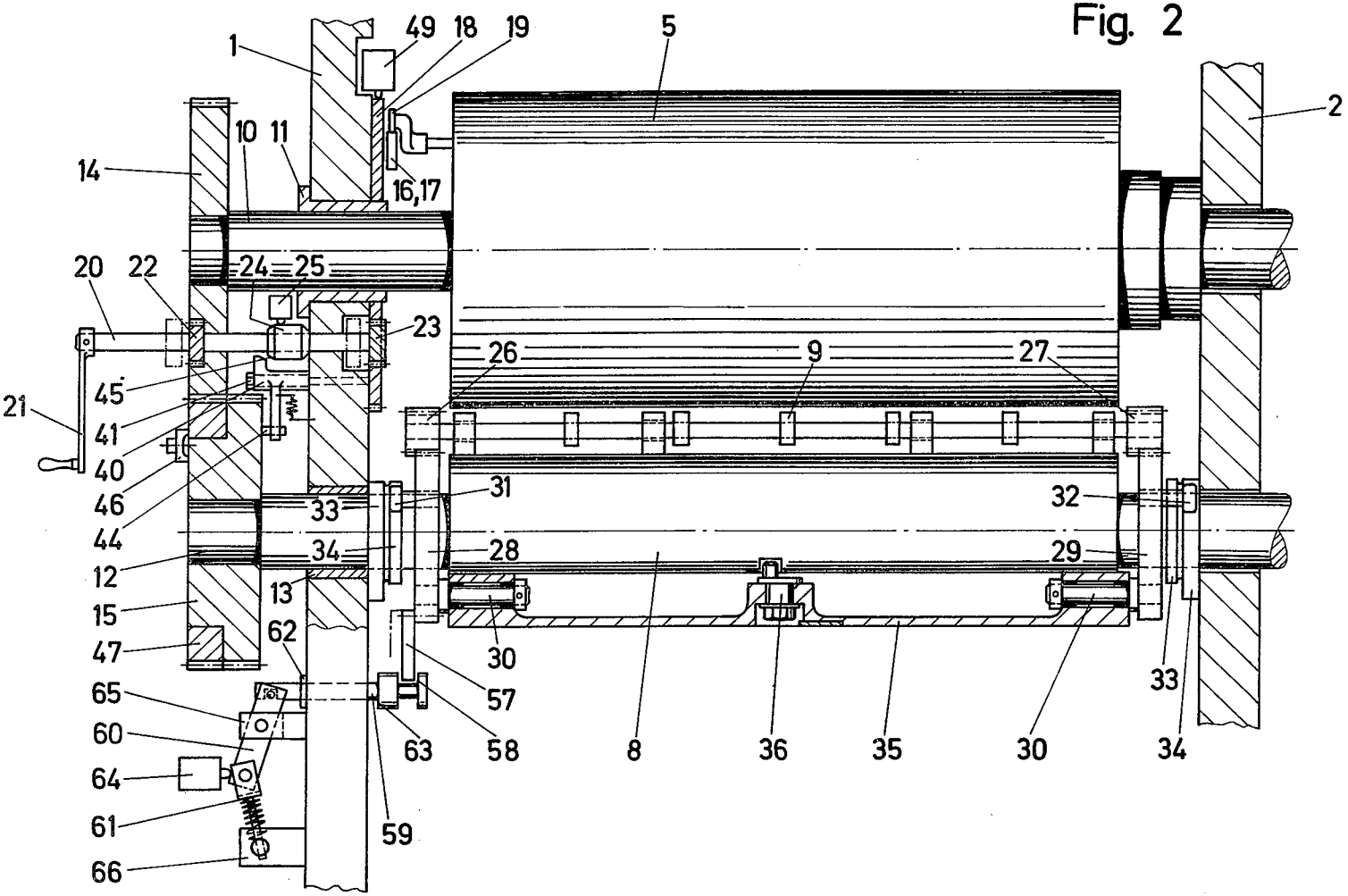
FIG. 2 is a longitudinal sectional view of FIG. 1 as seen from the left-hand side of the latter and omitting the transfer cylinder.

Referring now to the drawings, and first, particularly, to FIGS. 1 and 2 thereof, a transfer cylinder 3 with grippers 4, a sheet storage cylinder 5 with grippers 6 and 7 and a sheet turning cylinder 8 with tongs grippers 9 are shown mounted in a conventional manner between side frames 1 and 2 of a perfector printing machine. A shaft 10 of the storage cylinder 5 and a shaft 12 of the turning cylinder 8 are rotatably mounted by respective bearings 11 and 13 in the side frames 1 and 2. Gears 14 and 15 are respectively fastened on the shafts 10 and 12.

A gear or toothed segment 18, which is disposed coaxially to the shaft 10, serves to adjust control cams 16 and 17 on the storage cylinder 5. The grippers 6 and 7 are controlled by a cam roller 19 and the control cams 16 and 17.

An adjusting shaft 20 is rotatably mounted in the side frame 1 and in a non-illustrated gear box, and carries a crank handle 21 at the outer free end thereof. By axially shifting the adjusting shaft 20, a gear 22 fastened thereon is brought into meshing engagement with the gear 14, and a second gear 23 also fastened on the adjusting shaft 20 is brought into engagement with the gear segment 18. When the adjusting shaft 20 is shifted inwardly i.e. into the plane of the drawing in FIG. 1, a terminal switch 25 is actuated by a control cam 24, thereby preventing an unintentional start-up of the printing machine.

Figure 3:
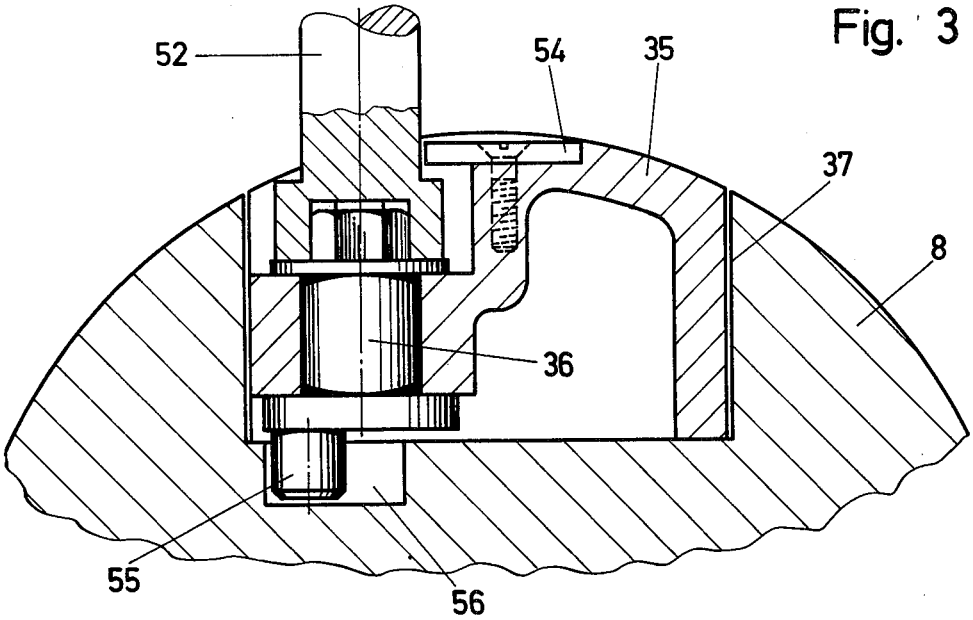
FIG. 3 is a fragmentary enlarged sectional view of FIG. 1 showing the turning drum with a shiftable bridge.

The tongs grippers 9 on the turning cylinder 8 are controlled by gears 26 and 27 and control segments 28 and 29 that are pivotally secured by pins 30 on the turning cylinder 8. The control segments 28 and 29 receive their control stroke through cam rollers 31 and 32 which roll off cams 33 and 34 that are disposed coaxially to the shaft 12. To shift the cam rollers 31 and 32 axially from the cams 33 to the cams 34, or vice versa, the pins 30 are mounted in a bridge 35, which is axially displaceable through an eccentric pin 36 in a recess 37 formed in the turning cylinder 8 (FIG. 3). By displacing the bridge 35 and the control segments 28 and 29 therewith, the cam rollers 31 and 32 mounted thereon are shifted between the cams 33 and 34 to adjust the movement of the tongs grippers 9 from printing on one side of a sheet to printing on both one and the other side of a sheet (perfector printing), or vice versa.

During a change-over of the printing machine from single-side sheet printing to double-side sheet (perfector) printing, the machine is initially brought by stepwise advancement into a zero position or setting indicated by an indicator 38 and a marking 39 on the turning cylinder 8. Due to an axial displacement of the adjusting shaft 20 with the crank handle 21, a spring or spring-loaded locking lever or safety catch 40, tiltably mounted by a pin 41 on the machine frame 1, is released by the control cam 24. The locking lever 40 is formed with a stop or notch 42 which, under the biasing action of a spring 43, engages a locking pin 44 on the drive gear 15. Thereby, the part of the machine that is not to be adjusted, for example, during the format adjustment, is protected against unintentional rotation and accordingly prevents falsification of the scale values that are read off. Upon withdrawal of the adjusting shaft 20, the locking lever 40, with the notch 42 formed therein, is lifted out of the locking pin 44 by a bevel 45 formed on the control cam 24.

In the inwardly shifted setting of the adjusting shaft 20, the gears 22 and 23 are in meshing engagement with the gear 14 and the gear segment 18. After loosening clamping jaws 46, the gear 14 and gear ring 47 can be rotated relative to the drive gear 15 by means of the crank handle 21. The storage cylinder 5 is accordingly turned with respect to the turning cylinder 8 and is thereby changed over from first-form printing to perfector printing. Turning of the gear segment 18 and, accordingly, of the control cams 16 and 17 occurs simultaneously. The gripper opening of the gripper 7 is thereby adjusted to change over to first form or perfector printing, as the case may be, or adjusted to the format to be processed. The gear segment 18 is formed at the periphery thereof with a depression 48 which cooperated with a switch 49. The switch 49 is located opposite the depression 48 when the machine is operating in the first-form or single-side sheet printing mode. When turning the gear segment 18 in order to effect a change-over to perfector printing i.e. printing on both sides of a sheet, the terminal switch 49 is disposed in the region 50 on a circular surface 51 of the gear segment 18. The contact position of the switch 49 varies in accordance with the size of the format which is to be set.

A socket wrench 52 formed with two flat surfaces 53 (FIGS. 4 and 5) is employed for axially adjusting the bridge 35 by means of the eccentric pin 36. The insertion and withdrawal of the wrench 52 is also electrically safeguarded, for example, by means of a non-illustrated protective covering over the cylinder which must be removed in order to insert the wrench 52 and thereby actuates a switch. A guide plate 54 is fastened to the bridge 35 and cooperates with the flats 53 on the socket wrench 52 so that the latter is insertable or withdrawable only in two positions or settings thereof in accordance with the flats 53. In this regard, the two flats 53 are disposed opposite one another, mutually offset 180°, so that the socket wrench 52 can be withdrawn only after being turned through 180°. With this turn, the eccentric pin 36 moves the bridge 35 a distance corresponding to the spacing between the two cams 33 and 34, thereby assuring that the cam rollers 31 and 32 run up onto the one or the other at the cams. This is achieved through the eccentricity with respect to the eccentric pin 36 of an eccentric peg 55 which is moved in a slot 56 formed at the base of the recess 37 (FIG. 3).

The control segment 28, which is axially shifted with the bridge 35, carries a switching finger 57, within the range of rotation of which, a space 58 between the tines of a fork-shaped push rod 59 is disposed. The push rod 59 is, in turn, operatively connected to a lever 60, which is displaced by a resilient or sprung control linkage 61, respectively, beyond a dead center to an end position thereof. For this purpose, two stops 62 and 63 are provided on the push rod 59. In the position of the lever 60 shown in FIG. 2, the lever 60 actuates a switch 64. The lever 60 and the control linkage 61 are rotatably mounted by bearings 65 and 66 on the machine frame 1.

If the bridge 35 is shifted and, therewith, the switch 64 actuated and the gear segment 18 also moved so that the terminal switch 49 is also actuated, when the turning cylinder 8 is in the zero position thereof, electrical blockage of the running of the machine is not effected if both switches 64 and 49 are in the provided switching position thereof. Thus, for example, provision can be made that the terminal switch 49 must be located in the depression 48 if the switch 64 is actuated by the lever 60 and, accordingly, the bridge 35 is located in the position thereof shown in FIG. 2. Assurance is simultaneously provided thereby that the storage cylinder 5 is also turned or adjusted to the first-form or single-side sheet printing position thereof, because the gear segment 18 and the gear 14, in the change-over position or setting of the adjusting shaft 20, are coupled by means of the two gears 22 and 23 that are mounted on the adjusting shaft 20.

To change the machine over from first-form printing to perfector printing, the machine is initially brought to the zero setting thereof in accordance with the mark 39, the adjusting shaft 20 is then shifted inwardly and the printing machine is accordingly blocked by the terminal switch 25. The locking lever 40 simultaneously makes contact with the pin 44 so that, after releasing or loosening the clamping jaws 46, the storage cylinder 5 and the gear segment 18 are turned. The switch 49 monitors this turning by coming to a stop either in the depression 48 or on the surface region 50. Thereafter, the bridge 35 is axially shifted by means of the socket wrench 52, the latter being turnable only through 180° and removable. This adjustment operation, in which the bridge 35 comes to rest either in the left-hand or right-hand end position thereof, as viewed in FIG. 2, is electromechanically monitored by the switch 64. After the adjusting shaft 20 has been withdrawn, the machine is changed over and again ready for production. Should an adjustment operation have been omitted, the machine remains electrically blocked, so that start-up thereof is impossible. The same applies also to the change-over of the machine from perfector printing to first-form printing, only that the adjustment of the individual elements is effected in reverse direction.

Figure 6:
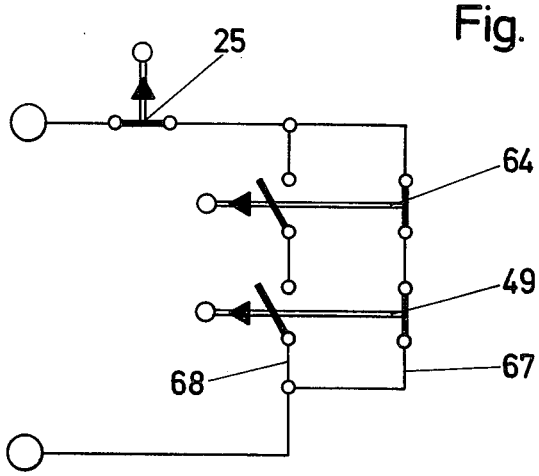
FIG. 6 is a circuit diagram for the switches in the embodiment of the invention shown in FIGS. 1 and 2.

In FIG. 6, a circuit diagram is shown with the switches 25, 49 and 64 in operating position thereof after change-over has been effected. In this regard, the switch 25 and the circuit 67 are closed while the circuit 68 is interrupted or open. If one of the switches 49 or 64 should not have been actuated properly, both circuits 67 and 68 would have been interrupted and the machine could not have started up. In the second change-over position of the machine, the circuit 68 is closed and the circuit 67 is interrupted or open.

Figure 4:
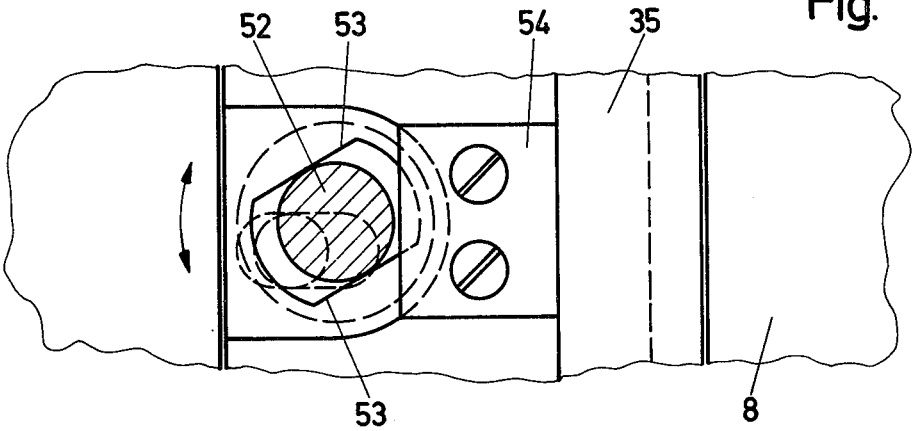
FIG. 4 is a top plan view partly in section, of FIG. 3 showing the shiftable bridge in one adjusted phase thereof.
Figure 5:
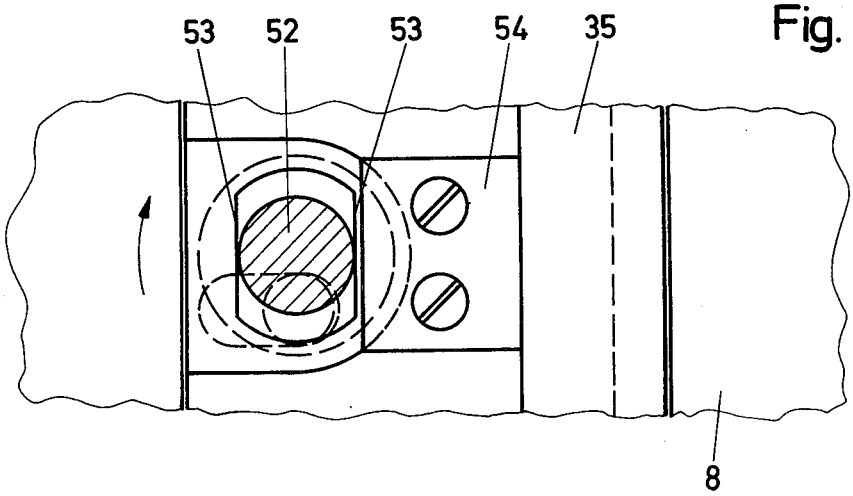
FIG. 5 is a view similar to that of FIG. 4 showing the shiftable bridge in another adjusted phase thereof.
Figure 7:
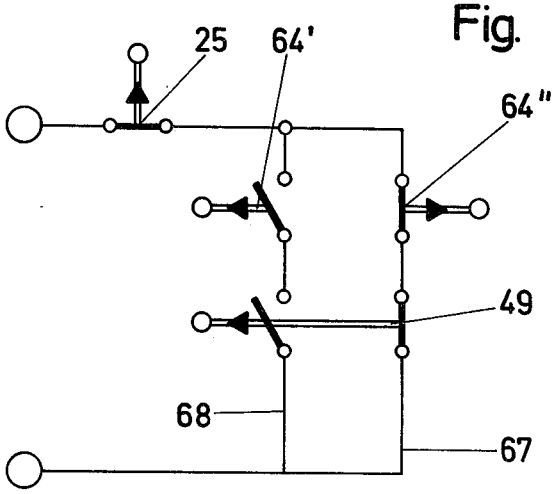
FIG. 7 is a circuit diagram for the switches in a modified embodiment of the invention.
Figure 8:
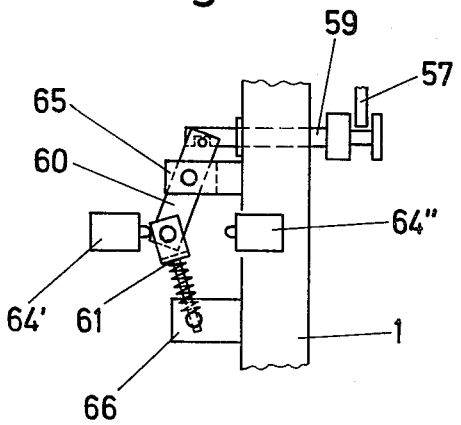
FIG. 8 is a fragmentary view of FIG. 2 showing a modification of the switching system thereof as connected in the circuit diagram of FIG. 7.
Figure 9:
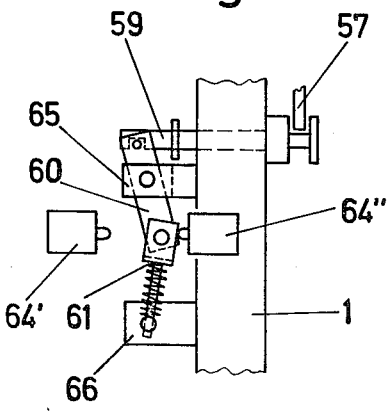
FIG. 9 is another view of the modified embodiment similar to that of FIG. 8 in another phase of operation thereof.

Instead of the flats 53 formed on the socket wrench 52 and the guide plate 54 according to the embodiment of FIGS. 3, 4 and 5, an alternative embodiment of the invention according to FIGS. 7, 8 and 9, employs two switches 64' and 64'', that are respectively actuated in each of the two end positions of the lever 60. Thus, for example, the switch 64' is actuatable in the perfector-printing setting of the bridge 35, and the switch 64'' in the first-form setting thereof. In this manner, also, a complete and correct change-over of the printing machine is assured, because the machine will start up only if, for example, as shown in FIG. 7, both switches 49 and 64'' close the circuit 67. A false or incomplete adjustment would neither close the circuit 67 nor the circuit 68 and would thereby block the machine.

FIGS. 6 and 7 clarify the dependent connection or wiring of the switches 49 and 64, on the one hand, and the switches 49, 64' and 64'', on the other hand, it being noteworthy that the switch 25 always breaks the circuit when the adjusting shaft 20 is shifted inwardly.

There are claimed:

1. Device for protecting a printing machine, selectively operable in a first-form printing mode or in a perfector printing mode, against damage thereto when changing over from one to the other mode of operation thereof, the printing press having a sheet-storage cylinder and a sheet turn-over cylinder cooperating with the sheet-storage cylinder, respectively means on each of the cylinders for gripping a sheet being printed, means comprising control cams and a gear segment turnably cooperating with said control cams for controlling the sheet-gripping means of the storage cylinder during change-over of the printing machine from one mode of operation to the other, and means for turning the storage cylinder into a respective change-over position, the device for protecting the printing machine comprising means for securing the turn-over cylinder against rotation while the storage cylinder is being turned by the turning means, means shiftable between respective end positions for controlling the sheet-gripping means of the turn-over cylinder during the change-over of the machine, electromechanical means for ensuring that the control means for the gripping means of the turn-over cylinder is in one of the respective end positions thereof, and electrical switching means responsive to a turning of the turnable gear segment and of the storage cylinder and cooperating with said electromechanical means for preventing operation of the printing machine until it is changed over to the respective mode of operation thereof.

2. Device according to claim 1 wherein the printing machine has a machine frame, and a drive gear for the turn-over cylinder, said means for securing the turn-over cylinder against rotation comprising a spring-loaded locking lever tiltably mounted on the machine frame and formed with a notch therein, and a locking pin on the drive gear engageable within the notch formed on said locking lever, the means for turning the storage cylinder into a respective change-over position being effective for engaging said locking pin in said notch.

3. Device according to claim 1 wherein said electromechanical means for ensuring that the control means for the gripping means of the turn-over cylinder is in the respective end position thereof comprises a sliding bridge mounted on said turning cylinder and having means for sliding said sliding bridge from one to another end position thereof, a socket wrench cooperating with said means for sliding said sliding bridge into a respective end position, said sliding bridge in said respective end positions thereof rendering effective the control means for the gripping means of the turn-over cylinder, an electric switch for switching off the printing machine, a spring-loaded switching linkage cooperable with said electric switch, and a switch finger operatively connected to said sliding bridge and engageable with said switching linkage for actuating said electric switch to switch off the printing machine.

4. Device according to claim 3 wherein said means for sliding said sliding bridge comprises a guide plate carried by said sliding bridge, and said socket wrench is formed with two opposed flats cooperating with said guide plate, said socket wrench being insertable and removable from said means for sliding said sliding bridge only when said sliding bridge is in one of said two end positions thereof.

5. Device according to claim 3 comprising a control segment carried by said sliding bridge, said switch finger being mounted on said control segment, a push rod connected to said switching linkage and being disposed within a range of turning of said switch finger, whereby said switch finger is turnable by the sliding of said sliding bridge so as to push said push rod and actuate said switching linkage and switch off said electric switch.

6. Device according to claim 3 wherein said electric switch is associated with another electric switch, both of said electric switches being on respective opposite sides of said spring-loading switching linkage and being alternatingly actuatable thereby, said electric switches being electrically connected, respectively, with said electrical switching means.

* * * * *